US007773892B2

(12) United States Patent
Nishimura et al.

(10) Patent No.: US 7,773,892 B2
(45) Date of Patent: Aug. 10, 2010

(54) IMAGE FORMING APPARATUS WITH VARIABLE PHOTOCONDUCTOR CHARGING AND VARIABLE DEVELOPING BIAS VOLTAGE

(75) Inventors: Yasuhiro Nishimura, Takaishi (JP); Toshiaki Ino, Kyoto (JP); Akiko Tsuji, Kameyama (JP)

(73) Assignee: Sharp Kabushiki Kaishi, Osaka (JP)

( * ) Notice: Subject to any disclaimer, the term of this patent is extended or adjusted under 35 U.S.C. 154(b) by 253 days.

(21) Appl. No.: 12/056,671

(22) Filed: Mar. 27, 2008

(65) Prior Publication Data

US 2008/0253780 A1 Oct. 16, 2008

(30) Foreign Application Priority Data

Apr. 10, 2007 (JP) ..... 2007-102984

(51) Int. Cl.
*G03G 15/08* (2006.01)

(52) U.S. Cl. ..... 399/27; 399/49; 399/50; 399/56; 399/72; 399/257

(58) Field of Classification Search ..... 399/27, 399/29, 49, 257, 258, 50, 72, 55, 56
See application file for complete search history.

(56) References Cited

U.S. PATENT DOCUMENTS 5,424,809 A * 6/1995 Sawayama et al. ..... 399/56
2006/0198644 A1 9/2006 Itagaki et al.

FOREIGN PATENT DOCUMENTS

| | | |
|---|---|---|
| JP | 4-068370 | 3/1992 |
| JP | 10-39553 A | 2/1998 |
| JP | 11-160930 A | 6/1999 |
| JP | 2002-131996 A | 5/2002 |
| JP | 2006-154170 | 6/2006 |
| JP | 2006-243115 | 9/2006 |
| JP | 2006-337699 A | 12/2006 |

OTHER PUBLICATIONS

JP Office Action mailed Sep. 15, 2009 in corresponding JP application 2007-102984.

* cited by examiner

*Primary Examiner*—Hoang Ngo
(74) *Attorney, Agent, or Firm*—Nixon & Vanderhye, P.C.

(57) ABSTRACT

An image forming apparatus including: an image forming section for forming an image, the image forming section including a photoconductor, a charging unit, a developing unit, a toner supply unit which supplies a toner to said developing unit, and a developing bias power supply section which supplies a developing bias voltage to said developing unit; and a controller that activates said image forming section, determines a target value of a charging potential of said photoconductor and/or a developing bias voltage, for forming the image, and controls the charging unit and/or the developing bias power supply section in accordance with a determined result, wherein when an absolute value of the determined target value of the charging potential or an absolute value of the determined developing bias voltage is larger than a prescribed value, said controller controls replacement of a prescribed amount of a toner in the developing unit.

15 Claims, 9 Drawing Sheets

0V
Vs
-600V
CHARGING POTENTIAL

EXPOSURE GRADATION CHARACTERISTICS
-50V
BRIGHT IMAGE PART (WHITE BACKGROUND PART)
DARK IMAGE PART

Vdv
DEVELOPING POTENTIAL -500V
100V

-50V
Vt
TRANSFER VOLTAGE -2kV

0V
-600V
-800V
Vs
CHARGING POTENTIAL

EXPOSURE GRADATION CHARACTERISTICS
-50V
DEVELOPING POTENTIAL -500V
-700V
BRIGHT IMAGE PART (WHITE BACKGROUND PART)
DARK IMAGE PART

-50V
Vdv
100V

Vt
TRNASFER VOLTAGE -2kV

IMAGE FORMING APPARATUS WITH VARIABLE PHOTOCONDUCTOR CHARGING AND VARIABLE DEVELOPING BIAS VOLTAGE

CROSS-REFERENCE TO RELATED APPLICATION

This application is related to Japanese application No. 2007-102984 filed on Apr. 10, 2007 whose priority is claimed under 35 USC §119, the disclosure of which is incorporated by reference in its entirety.

BACKGROUND OF THE TECHNOLOGY

1. Field of the Technology

The technology relates to an image forming apparatus capable of controlling a charging potential of a photoconductor and a developing bias voltage in an electrophotographic process, and having a function of adjusting a density of a formed image.

2. Description of the Related Art

When an image with a low toner coverage ratio, namely, an image having few parts where toner is adhered out of an entire area of a print image, is printed continuously, it is known that a granular "fog" (phenomenon that the toner is adhered to a white background part where the toner is not supposed to be adhered) is generated eventually. Although a cause of this type of fog is not clarified, it is empirically known that after printing at a low toner coverage ratio is continued to some extent, the fog is generated. From this fact, it is estimated that when the same toner is retained in a developing unit, a kind of deterioration occurs to the toner, thus causing the fog.

Generation of the fog is not preferable in terms of image quality. Therefore, a technique of preventing the fog is proposed, in such a way that the fog on the photoconductor caused by the deterioration of the toner is detected by an optical sensor, and when the fog is generated, a toner image is formed on both ends in a direction of a photoconductor rotation axis outside of an image area, and the toner is forcibly discharged to replace the toner (for example see Japanese Unexamined Patent Publication No. 2006-243115).

However, since the fog is a phenomenon in which the toner is extremely thinly applied to a non-image area, it is difficult to stably detect the fog with accuracy. In addition, it may be preferable to predict the generation of the fog and then cope with the fog, rather than coping with the fog after actually it is generated.

As a result of earnest efforts to study on a condition of allowing the fog to be generated after printing at a low toner coverage ratio, inventors of the technology find a point that there is a correlation between the charging potential of the photoconductor and the generation of the fog. Namely, it is found that the larger an absolute value of the charging potential of the photoconductor is, the more easily the fog is generated. Moreover, it is found that when the toner is retained for a long period in the developing unit, the density of the image hardly appears. As a result, it is found that an image density adjustment process control executed so as to stabilize the image density makes an absolute value of the charging potential of the photoconductor large, thus leading to a circumstance where the fog is easily generated.

In addition, it is confirmed that there is a correlation between a use period of the photoconductor and the generation of the fog. Namely, it is confirmed that when the photoconductor is new, the fog is hardly generated, and as the use period is elapsed, the fog is easily generated.

Neither deterioration of the image density nor the fog is preferable, in terms of the image quality. The deterioration of the image density and the fog must be suppressed, so as not to be recognized by a user. However, in a case where the charging potential is controlled to stabilize the image density when the printing at a low toner coverage ratio is continued as described above, the fog is easily generated. Accordingly, there is desired a technique capable of accurately predicting or determining a condition where the fog is easily generated, and a technique capable of appropriately coping with such a condition.

SUMMARY OF THE TECHNOLOGY

The technology is provided in view of the above-described circumstances, and the present invention is directed to providing a technique capable of accurately predicting the fog generated after printing at a low toner coverage ratio is continued. In addition, from a viewpoint different from the above, the technology is directed to providing a technique capable of determining a condition where the fog is easily generated without requiring extra cost and time.

The technology provides an image forming apparatus including: an image forming section for forming an image by an electrophotographic process, the image forming section including a photoconductor, a charging unit, a developing unit, a toner supply unit which supplies a toner to said developing unit, and a developing bias power supply section which supplies a developing bias voltage to said developing unit; and a controller that activates said image forming section to form the image, determines a target value of a charging potential of said photoconductor and/or a developing bias voltage, for forming the image, and controls the charging unit and/or the developing bias power supply section in accordance with a determined result, wherein when an absolute value of the determined target value of the charging potential or an absolute value of the determined developing bias voltage is larger than a prescribed value, said controller controls replacement of a prescribed amount of a toner in the developing unit.

According to an image forming apparatus, a controller controls so that a prescribed amount of toner in a developing unit is replaced, when a determined target value of a charging potential becomes larger than a prescribed value as an absolute value. Therefore, it is possible to accurately determine a condition where the fog is easily generated in terms of an image forming condition and a generation of the fog can be prevented by replacing at least a part of the toner in the developing unit. In addition, it is possible to determine the condition where the fog is easily generated without requiring extra costs and time.

Alternately, the controller controls, so that the toner of a prescribed amount in the developing unit is replaced, when an absolute value of the decided developing bias voltage is larger than a prescribed value. Therefore, it is possible to accurately determine the condition where the fog is easily generated in terms of an image forming condition, and the generation of the fog can be prevented by replacing at least a part of the toner in the developing unit. Further, it is possible to determine the condition where the fog is easily generated without requiring extra cost and time.

DETAILED DESCRIPTION OF THE TECHNOLOGY

Figure 1:
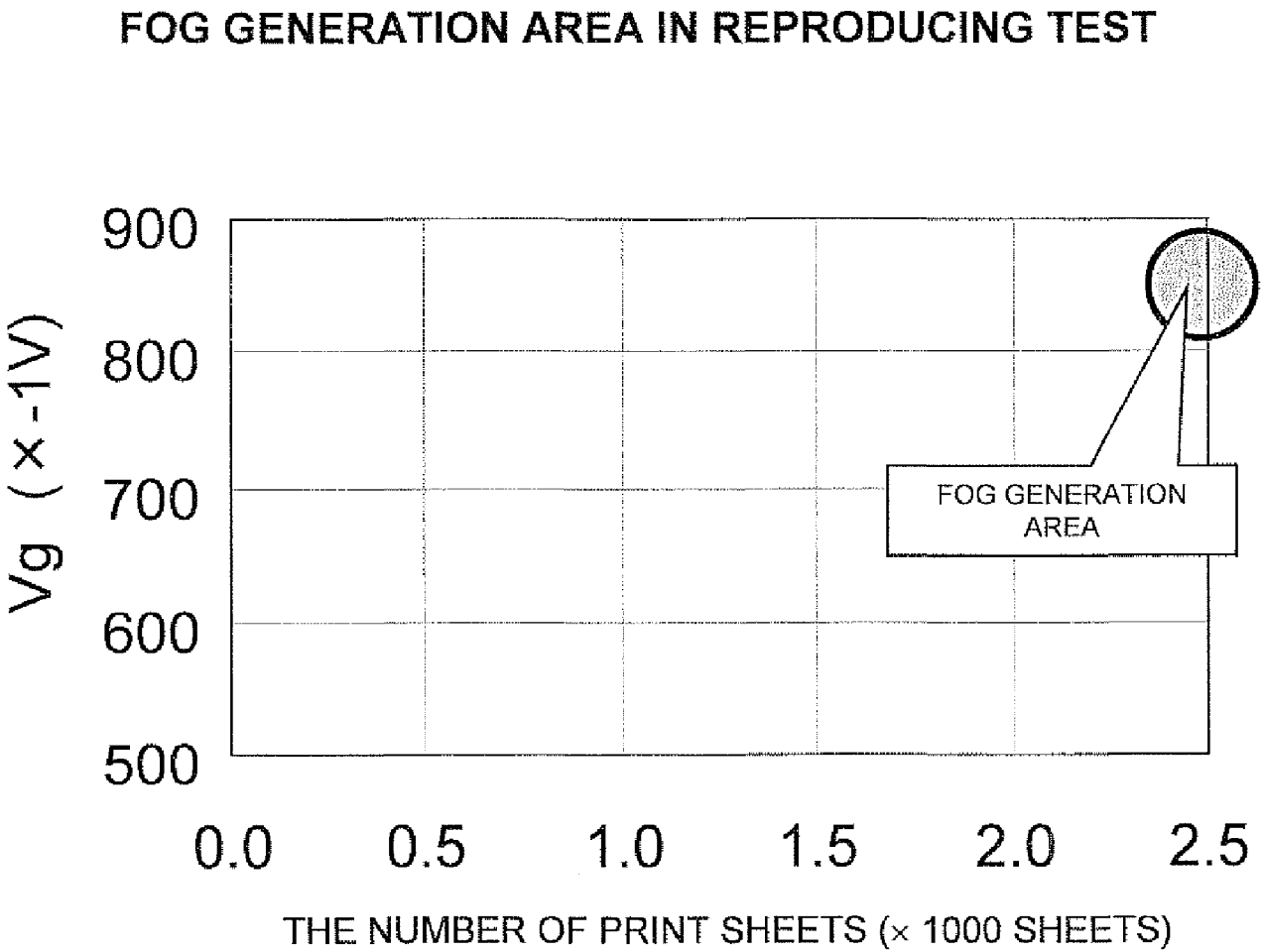
FIG. 1 is a graph illustrating a condition where a granular fog is easily generated after printing at a low toner coverage ratio.

The system, type, and structure of the photoconductor, the charging unit, the developing unit, the toner supply unit, the developing bias power supply section, which configure the image forming section, are not particularly limited, provided that they can be applied to the image forming apparatus of an electrophotographic system. The controller may be realized, by executing a control program showing a procedure of the processing by, for example, a microcomputer or a CPU. However, the controller is not limited thereto, and, for example may be realized only by a circuit as hardware.

Preferred embodiments will be explained hereunder.

The image forming apparatus may further include: a density measuring section for measuring a density of the formed image, wherein when a prescribed opportunity comes, said controller may activate the image forming section to form an image of a pattern having the prescribed amount of a toner, may activate the density measuring section to measure a density of said image, may calculate a target value of the charging potential and a developing bias voltage, based on the measured result, may control subsequent image formation based on the calculated result, and may determine whether or not the toner is replaced before a next image is formed. With this structure, after the charging potential and/or the developing bias voltage are updated for stabilizing the image density, it is determined whether or not executing the process (toner replacing process) for replacing the toner before forming the next image. Therefore, the timing for updating the image forming condition and the timing for determining necessity for the toner replacing process are synchronized with each other. Accordingly, the image forming condition is not carelessly updated to allow the fog to be generated, and the toner replacing process is not uselessly executed.

The controller may activate the image forming section to form an image of a pattern using said prescribed amount of a toner, then may activate the toner supply unit to replenish the developing unit with a new toner so as to make the replacement of the toner. Thus, the replacement of the toner can be realized, without adding a dedicated mechanism.

Also, the pattern using the prescribed amount of the toner may have a width almost equal to a maximum width which can be developed, and may be a substantially uniform halftone or dot-shaped pattern. Thus, the toner can be uniformly consumed approximately over an entire area of the developing unit. In addition, by adjusting an average gradation value of a pattern, a speed for consuming the toner can be set to a proper speed.

Still further, the pattern using the prescribed amount of the toner may be in a prescribed size. Thus, a prescribed amount of toner can be consumed by a single toner replacing process.

The image forming apparatus may further include a transfer section that transfers the image formed by the image forming section to a printing sheet; and a transferring power supply section that is capable of applying a transfer voltage to the transfer section, wherein said controller may control the transferring power supply section so that the transfer section floats potentially or a voltage of a polarity which is the same as a charging polarity of the toner is applied to the transfer section, while said pattern using the prescribed amount of the toner passes through the transfer section.

Further, the transfer section may have a transfer member coming in contact with a surface of the photoconductor, and said controller may control the transferring power supply section so that the voltage of the same polarity as the charging polarity of the toner and the voltage of an absolute value larger than that of the charging potential of the photoconductor may be applied to said transfer member, after said pattern using the prescribed amount of the toner passes through the transfer section. Thus, by applying the voltage, the transfer member can be electrostatically cleaned.

Still further, the photoconductor may be formed in an endless shape to rotate when an image is formed, and said controller may control the transferring power supply section so that said voltage is applied to said transfer member, while the photoconductor rotates two or more times after said pattern using the prescribed amount of the toner passes through the transfer section. Thus, the transfer member can be surely cleaned.

The image forming apparatus may further include: a toner coverage ratio recognizing section that recognizes a toner coverage ratio of an image before the image is formed, wherein said controller may control the replacement of the toner only when the recognized toner coverage ratio is under a prescribed value, and the toner is not replaced when a toner coverage ratio of an image to be formed is recognized and the recognized toner coverage ratio is the same as the prescribed value or more, even if the absolute value of the target value of the charging potential or the absolute value of the developing bias voltage according to said target value is a value in which a process of replacing the toner is carried out. When it is known that the image with the toner coverage ratio set at a prescribed value or more is printed next, the toner of the developing unit is replaced by developing this image. In this case, consumption of the toner can be suppressed, without daringly executing the toner replacing process.

Also, the controller may control the replacement of the toner such that the toner is consumed while the developing unit is not replenished with a new toner at first, and then the developing unit is replenished with the new toner, in a process of replacing the toner. Thus, the toner in the developing unit can be efficiently replaced.

Further, the controller may control the replacement of the toner such that the consumption of the toner is discontinued when a toner density in the developing unit decreases to a prescribed lower limit while the process of replacing the toner is carried out. Thus, it is possible to prevent the generation of a secondary adverse effect that is generated when toner concentration is excessively lowered, such as a drop of a carrier or damage of a blade for cleaning the photoconductor.

Further, the controller may control the replacement of the toner such that the developing unit is replenished with a new toner after the consumption of the toner is discontinued, and then the toner is consumed again.

In addition, the image forming apparatus may further include: a transfer section that transfers the image formed by the image forming section to a printing sheet; and a sheet supply section that supplies a printing sheet to the transfer section, wherein said controller may further control said sheet supply section so that said printing sheet is not supplied to the transfer section while a process of replacing the toner is carried out. Thus, wasteful consumption of the sheet can be prevented.

A plurality of various preferable embodiments shown here can be combined.

The technology will be described in detail by using the drawings. Note that explanation given hereunder is shown for examples and should not be interpreted as restricting the technology.

Generation Condition of a Fog after Printing at a Low Toner Coverage Ratio

First, explanation is given for a result of a test for confirming correlativity between the fog that is generated after printing at a low toner coverage ratio, and a charging potential. Printing was performed with various grid voltages and a generation circumstance of the fog was observed, so as to reproduce the generation of a granular fog that is generated after printing at a low toner coverage ratio. A size of an image is A4 size, and the toner coverage ratio is 4.0%. A result is shown in FIG. 1. In FIG. 1, a horizontal axis indicates the number of print sheets, and a vertical axis indicates the grid voltage. The grid voltage is almost equal to a charging potential of a photoconductor drum. In FIG. 1, an area surrounded by a gray circle shows an area in which the generation of the fog is observed. When the number of print sheets reaches almost 2,500 sheets, the fog is generated in the area with the grid voltage set at Vg=−800 to −900V. Here, a standard grid voltage is approximately −600V when a photoconductor drum 202 and a developer are new. Also, a controllable range of the grid voltage is 500V to 900V. Note that an evaluation of the fog is performed, by sampling the toner adhered to a non-image part in printing with an adhesive tape at a time when printing was performed so that toner adhesion on the photoconductor was adjusted to be 0.4 mg/cm$^2$, and its image density (ID) was measured with a color measurement color-difference meter (product name: by X-Rite, X-Rite INC.). When the ID is 0.2 or less, this image density is determined to be a defect.

As is shown in FIG. 1, after the printing at a low toner coverage ratio is continued for a certain period, the fog to be measured is generated. However, when the grid voltage is set in a range from −500 to −800V, the fog to be measured is not generated even in a case where the number of print sheets reaches near 2,500 sheets. It is found that when the absolute value of the grid voltage is high, the fog is easily generated.

Overall Structure of the Image Forming Apparatus

Before the explanation is moved to a technique of suppressing the fog, the explanation will be given for the structure of the image forming apparatus, which is a base of this technique. Namely, the structure of an image forming section will be explained.

Figure 2:
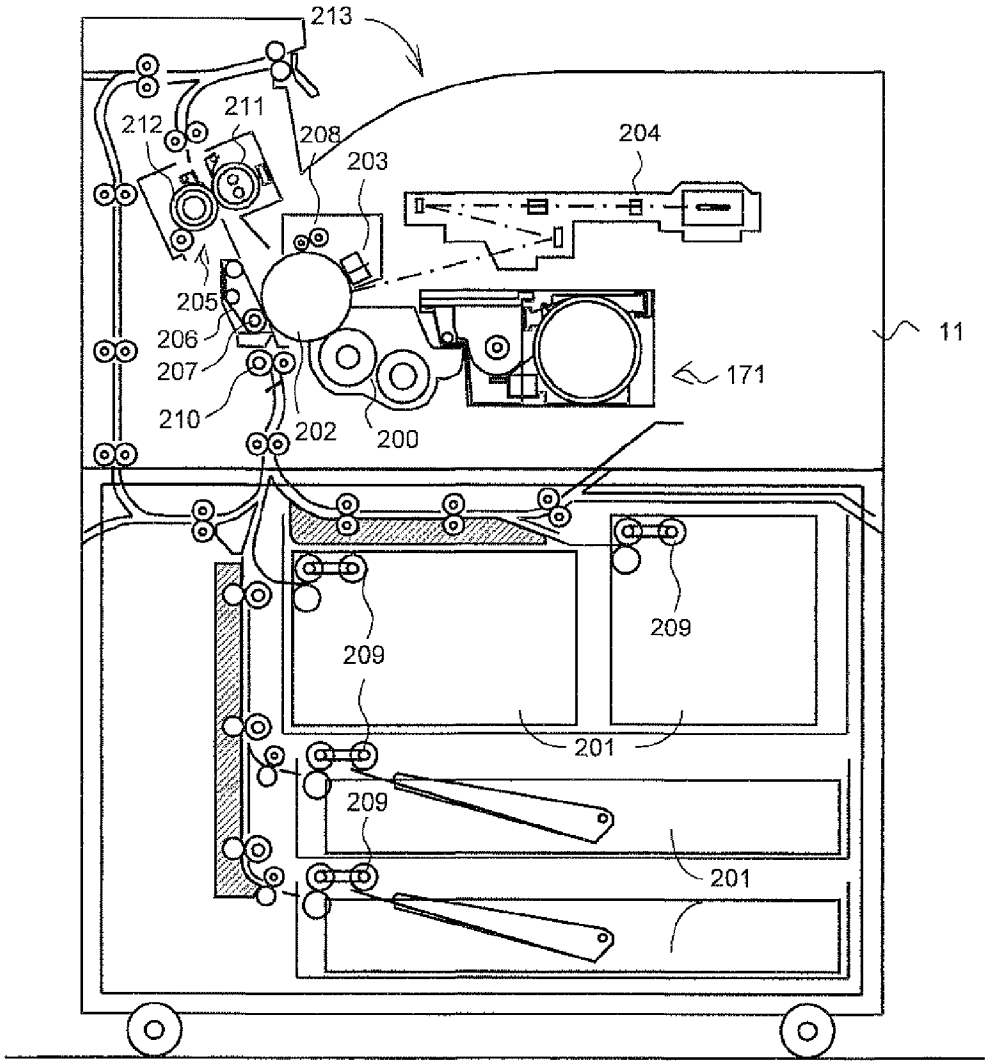
FIG. 2 is an explanatory view illustrating a mechanical structure of an electrophotographic printer according to one aspect of an image forming apparatus.

FIG. 2 is a mechanical structure of an electrophotographic printer, being one aspect of the image forming apparatus. In FIG. 2, an image forming apparatus 11 forms an image of image data read by an image reading apparatus (not shown) and print data inputted from external equipment (for example, an image processing apparatus such as a personal computer) via a communication line, then transfers and outputs the formed image on a sheet for print (print sheet).

Each unit for electrophotographic process is disposed in the image forming apparatus 11, with a photoconductor drum 202 as a center, and the image is formed by an operation of them. The photoconductor drum 202 is configured so that a photoconductive layer is formed on a peripheral surface of a conductive base material (such as aluminum). The base material is electrically grounded to earth. A charger 203, a developing unit 200, a transfer roller 207, cleaning unit 208, and an optical scanning unit 204, etc, are disposed in this order, around the photoconductor drum 202. The photoconductor drum 202 is driven by a process drive motor as will be described later (see FIG. 4), and is rotated at a constant speed.

A surface of the photoconductor drum 202 is uniformly charged by the charger 203. A scorotron-type charger 203 of the present embodiment is a scorotron-type charger having a corona discharge section and a control grid. The surface of the photoconductor drum 202 is charged to a potential substantially equal to the grid voltage. Note that other system such as a charging roller may be used for the charger 203. The optical scanning unit 204 functions to scan the surface of the uniformly charged photoconductor drum 202 with optical beams to form an electrostatic latent image on the surface. The developing unit 200 contains a developer inside thereof to develop the electrostatic latent image written by the optical scanning unit 204 with toner. Note that the developer is configured by toner and carrier, and by being stirred in the developing unit 200, the toner is charged to a positive polarity by friction with the carrier. A toner container 171 for containing the toner supplied to the developing unit 200 is fitted to the developing unit 200.

The transfer roller 207 is a roller for transferring the image developed on the photoconductor drum 202 to a print sheet thereby to form a visible image on the sheet. The transfer roller 207 is formed of a metallic shaft member and a conductive elastic material wound around its peripheral surface (such as EPDM and urethane foam). The transfer roller 207 is driven by the process drive motor, and a voltage from a transfer power supply as will be describe later is applied to the shaft member of the transfer roller 207. A transfer belt 206 extending to a lower stream side in a feeding direction is mounted on the transfer roller 207. The transfer belt 206 is configured by resin or rubber having conductivity so that a volume resistance rate has a prescribed value (for example, in a range of $1\times10^9$ to $1\times10^{13}$ Ω·cm).

The cleaning unit 208 removes the developer remained on the photoconductor drum 202.

A sheet feeding tray 201 incorporated in the image forming apparatus 11 is disposed in a lower part of the image forming apparatus 11. The sheet feeding tray 201 is a tray for housing print sheets. The print sheets contained in the sheet feeding tray 201 are separated one by one by a pickup roller 209, and the separated sheet is then fed to a registration roller 210, and is sequentially fed between the transfer roller 207 and the photoconductor drum 202 in synchronization with the timing of the image formed on the photoconductor drum 202 with the registration roller 210. The voltage for transfer (transfer voltage) is applied to the transfer roller 207. The toner developed and adhered to the photoconductor drum 202 is transferred to the sheet by the transfer voltage.

A fuser unit 205 is disposed in the image forming apparatus 11. The fuser unit 205 is a nip part where a heat roller 211 and a pressure roller 212 are brought into contact with each other, so that the toner transferred to the sheet is melted by heat and is fused to the sheet by pressure.

The sheet passing through the fuser unit 205 is further fed and ejected to a sheet exit tray 213.

Note that in FIG. 2, a monochromatic image forming apparatus is exemplified. However, the technology is not limited thereto and can be applied to a full color image forming apparatus.

Structure of a Developing Unit

Figure 3:
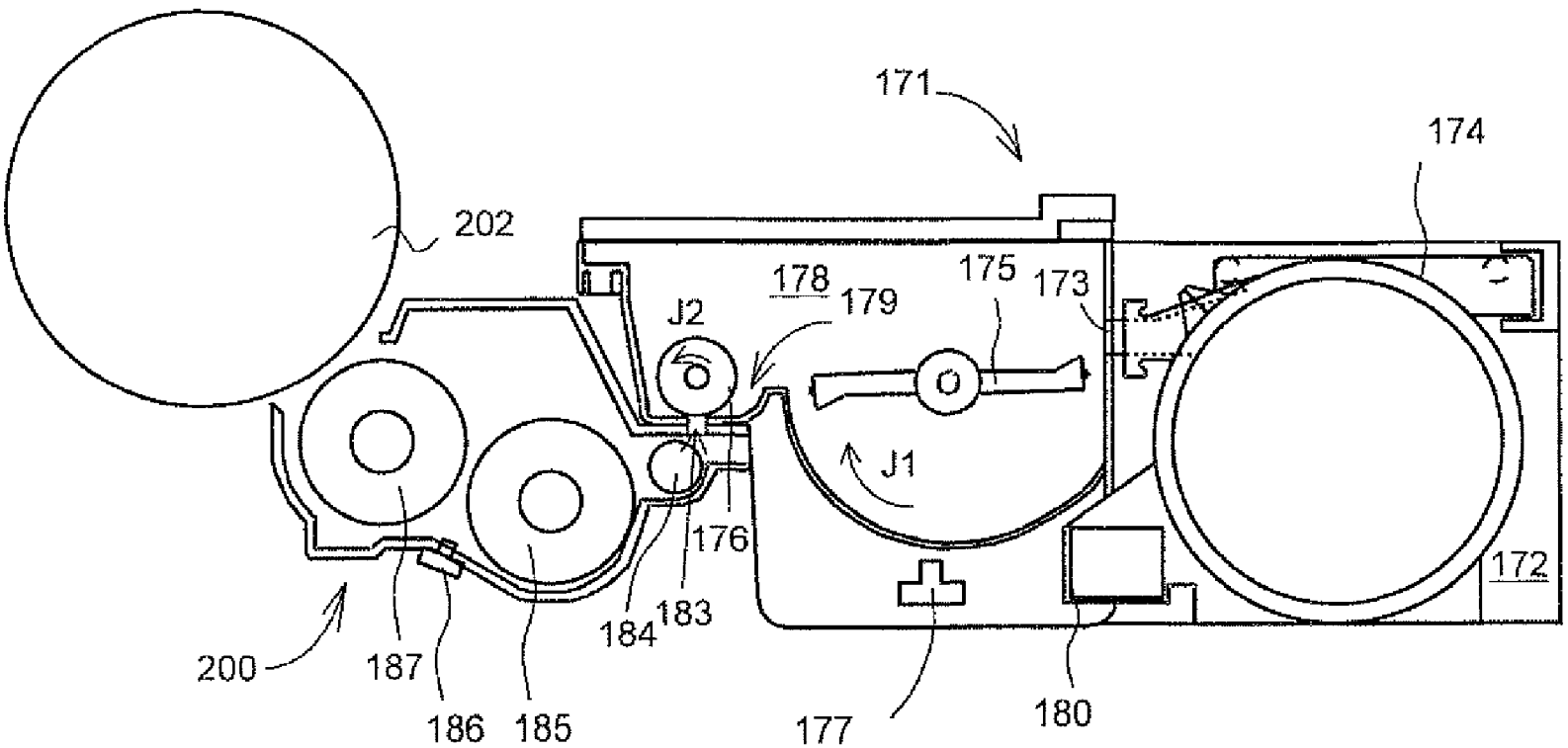
FIG. 3 is a sectional view illustrating structures of a development section and a toner container of the electrophotographic printer shown in FIG. 2.

In this embodiment, details of the developing unit 200 and the toner container 171 of the aforementioned image forming apparatus will be explained. FIG. 3 is a sectional view showing the details of the developing unit 200 and the toner container 171 of the image forming apparatus 11 shown in FIG. 2. As shown in FIG. 3, a developing roller 187 of the developing unit 200 is disposed so as to be opposed to the surface of the photoconductor drum 202. The developing roller 187 supplies the toner to the surface of the photoconductor drum 202 to adhere the toner to the electrostatic latent image for developing the adhered toner. The developing roller is driven by the aforementioned process drive motor. In addition, the surface of the developing roller is configured by a non-magnetic conductive member (such as an aluminum material), and the voltage is applied to this conductive member from a transfer power supply as will be described later (see FIG. 4). In the developing unit 200, a toner concentration sensor 186 detects toner concentration, so as to constantly supply the toner of prescribed concentration to a part around the developing roller. The controller (not shown) obtains an output of the toner concentration sensor 186 and controls supply of the toner. The toner is supplied from the toner container 171. The toner container 171 is configured by a toner hopper 178 for stirring the toner and a toner bottle loading part 172 for loading a cylindrical toner bottle 174. The toner bottle 174 is loaded by a user. The toner is contained inside of the toner bottle 174. The toner in the toner bottle 174 is fed to a toner supply port 173 by a toner feeding mechanism not shown. The toner feeding mechanism is driven by a toner feeding motor as will be described later (see FIG. 4), to feed the toner.

The toner fed from the toner supply port 173 is guided into the toner hopper 178. A stirring roller 175 driven by the toner feeding motor as will be described later (see FIG. 4) to rotate in a direction indicated by an arrow J1 is disposed in the toner hopper 178. The stirring roller 175 stirs the toner, so that fluidity is kept uniform, and feeds the toner to a toner storage part 179 near the toner supplying roller 176. In addition, a toner feeding sensor 177 is disposed in the toner storage part 171. The toner feeding sensor detects the toner in the toner hopper 178 which is lower than a prescribed amount to generate a signal for replenishing the toner from the toner bottle. The toner feeding sensor 177 is a light reflection sensible sensor, being a sensor for detecting an existence/non-existence of the toner in the toner hopper 178, by irradiating an object to be detected with light and determining a state of the object with a reflection degree of light. The controller (not shown) controls an operation of the toner feeding mechanism in accordance with the output of the toner feeding sensor 177. Thus, the toner amount in the toner hopper 178 is maintained in a prescribed range.

The toner supplying roller 176 is a roller for supplying a prescribed amount of toner to the developing unit 200. The toner supplying roller 176 is formed by having a porous resilient member such as ester-based polyurethane, being a so-called porous resilient member such as a sponge, wound on a solid shaft made of stainless. A slit-shaped toner drop opening part 183 is formed in a lower part of the toner supplying roller 176, so as to communicate with the developing unit 200. The toner supplying roller 176 is disposed so as to cover an entire surface of the toner drop opening part 183 with its porous resilient member. In addition, the toner supplying roller 176 is driven by the toner supply motor and is rotated in a direction indicated by an arrow J2.

When the toner supplying roller 176 is rotated, the toner of the toner storage part 179 enters a hole part of the surface of the porous resilient member. When this toner reaches the toner drop opening part 183, the surface of the toner supplying roller 176 is brought into contact with an edge of the toner drop opening part 183 and is deformed. With this deformation, the toner is separated from the hole part, and drops to an inside of the developing unit 200 from the toner drop opening part 183 by its own weight.

When the toner supplying roller 176 stops, the entire surface of the toner drop opening part 183 is covered with the porous resilient member of the toner supplying roller 176. Accordingly, in a state where the toner supplying roller 176 is stopped, the toner in the toner hopper 178 is prevented from moving to the developing unit 200.

The toner that drops into the developing unit 200 from the toner drop opening part 183 is carried by a carrying screw 184 in a development bath, and is stirred with the carrier by a stirring screw 185, and is fed to a surface part of the developing roller 187 by an action of the stirring screw 185.

A toner concentration sensor 186 is provided at a bottom part of the developing unit 200. The toner concentration sensor 186 detects a concentration of the toner fed to the surface part of the developing roller 187. Here, the concentration of the toner refers to a ratio of a weight of the toner over the weight of the developer which is formed by combining the carrier and the toner. When the electrostatic latent image on the photoconductor drum 202 is developed, the toner is consumed. When reduction of the toner in the developing unit is recognized by the signal from the toner concentration sensor 186, the controller (not shown) rotates the toner supply motor. When the toner supply motor is rotated, the stirring roller 175 and the toner supplying roller 176 are rotated and the toner is supplied into the developing unit 200. Moreover, the controller stops the toner supply motor when the toner concentration reaches a prescribed value. Thus, the toner concentration in the developing unit 200 is controlled in a prescribed range.

Control of Electrophotographic Process

Next, explanation will be given for a functional structure for controlling an image forming condition of an electrophotographic process with the image forming apparatus 11 in FIG. 2. Namely, the controller will be explained.

Figure 4:
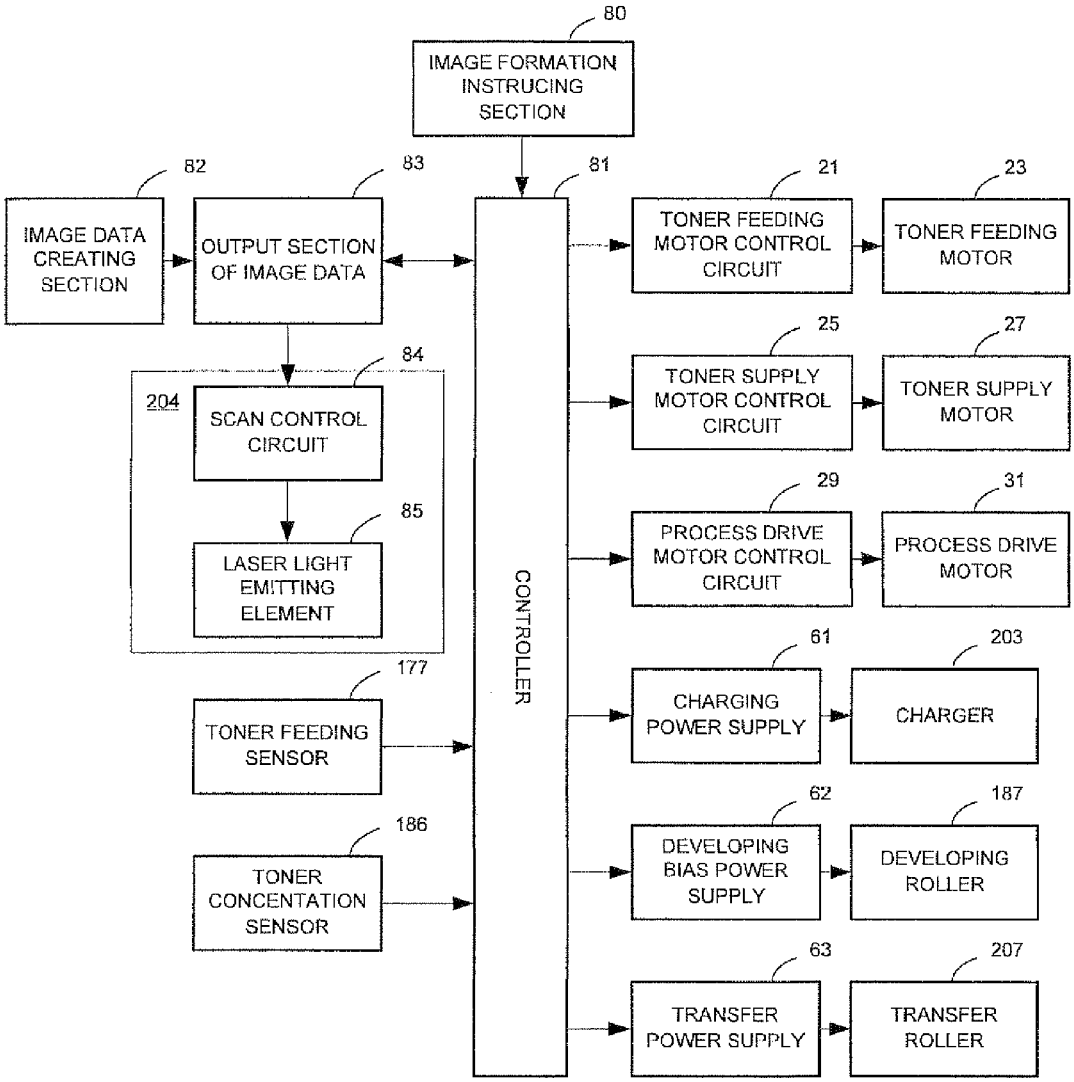
FIG. 4 is a block diagram illustrating a structure of a functional block regarding a control of an electrophotographic process according to this embodiment.

FIG. 4 is a block diagram illustrating the structure of a functional block regarding a control of the electrophotographic process according to this embodiment. In FIG. 4, an image forming instruction section 80 is a block for sending an instruction of image formation to a controller 81. When the image forming apparatus 11 has a copy function, the image forming instruction section 80 may send a signal showing a message that a copy start key provided on an operation panel not shown of the image forming apparatus 11 is pressed. Hardware of the controller 81 may be, for example, a microcomputer. With the execution of a control program by the microcomputer, a function of the controller 81 is realized. The controller 81 recognizes a state where the copy start key is pressed, as a start request of a copy job. The hardware of the image forming instruction section 80 may be a key and a circuit of the operation panel. In addition, when the image forming apparatus 11 has a function of a printer, the image forming instruction section 80 may be a communication circuit for receiving a command and print data from a host via a communication line. The controller 81 analyzes a content of the received command to recognize the start request of the print job.

The controller 81 receives the start request of a job from the image forming instruction section 80, being the instruction of the image formation, and controls each block regarding the electrophotographic process. The function of each block is as follows.

In a case of a copy job, an image data creating section 82 is a block that processes image data of a document read by a scanner, and creates the image data to be printed. In a case of a printer, the image data creating section 82 is also a block that develops the print data received from the host to create the image data to be printed. Its hardware is configured by storage elements such as an LSI and RAM, ROM, and nonvolatile memory.

An image data output section 83 processes the image data created by the image data creating section 82 to create an output signal to an optical scanning unit 204. Note that preferably, the image data creating section 82 or the image data output section 83 have a function of providing a toner coverage ratio of each page to form an image, prior to printing. This function can be realized by a circuit or a program for counting the number of print pixels of the image data in a page unit.

The optical scanning unit 204 includes a laser light emitting element 85 and a scan control circuit 84 for PWM-modulating a light emitted by the laser light emitting element 85. The scan control circuit 84 PWM-controls on/off of the light emission of the laser light emitting element 85 in accordance with a signal inputted from the image data output section 83. The laser light emitting element 85 emits laser beams which is PWM-modulated by the scan control circuit 84 toward a peripheral surface of the photoconductor drum 202. The laser beams are deflected by a polygon mirror (not shown). The deflected laser beams scan the peripheral surface of the photoconductor drum 202 along a direction of its rotating shaft. The photoconductor drum 202 rotates along with a rotation of a photoconductor drive motor 56. The peripheral surface of the photoconductor drum 202 is selectively exposed to light in cooperation of the scan of the modulated laser beams and the rotation of the photoconductor drum 202, and an electrostatic latent image is thereby formed. A process drive motor control circuit 29 controls rotation, stop, and a rotation speed of a process drive motor 31.

The controller 81 obtains a signal from the toner feeding sensor 177 and outputs a control signal to a toner feeding motor control circuit 21. The toner feeding motor control circuit 21 receives the control signal and controls the rotation and the stop of a toner feeding motor 23. Also, a controller 81 obtains the signal from a toner concentration sensor 186 and outputs a control signal to a toner supply motor control circuit 25. The toner supply motor control circuit 25 receives the control signal and controls the rotation and the stop of a toner supply motor 27.

Further, the controller 81 controls, so as to turning on/off a charging power supply 61, a developing bias power supply 62, a transfer power supply 63 at a prescribed timing. The charging power supply 61 applies a discharge voltage to a corona discharge section of a scorotron-type charger 203, and also applies a grid voltage to a control grid. The grid voltage, an output voltage of the developing bias power supply 62 (developing bias voltage), and an output voltage of the transfer power supply 63 (transfer voltage) are variable and controlled by the controller 81. Note that a ground potential is set as a reference of the grid voltage, the developing bias voltage, and the transfer voltage. Next, a voltage control of them will be explained.

Potential Control of a Process

Figures 5A, 5B, 5C, 5D:
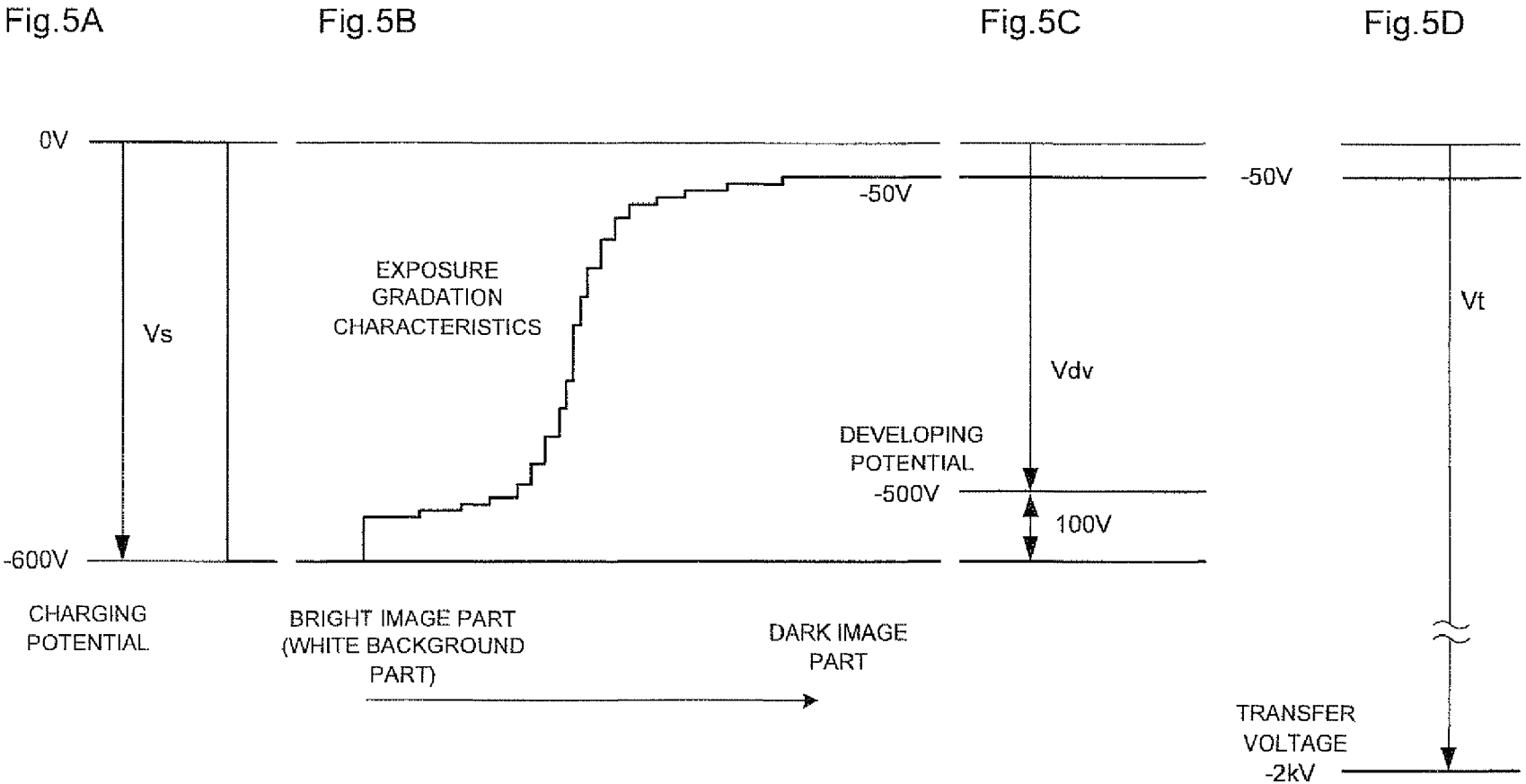
FIGS. 5A to 5D are explanatory views schematically illustrating an example of a charging potential, a potential of an electrostatic latent image of the electrophotographic process having a plurality of image densities, a developing potential and a transfer voltage according to this embodiment.

In this embodiment, explanation will be given for a potential control of the electrophotographic process by the controller and particularly the control of a charging potential and the developing bias voltage. FIGS. 5A to 5D are explanatory views schematically illustrating an example of a charging potential, a potential of an electrostatic latent image of the electrophotographic process having a plurality of image densities, a developing potential and a transfer voltage according to this embodiment. FIG. 5A shows that a charging potential Vs of the peripheral surface of the photoconductor drum 202 by the charger 203 is set at −600V, against 0V, namely, the ground potential. The charging potential Vs has an almost equal value to the value of the grid voltage Vg. Vs=Vg is assumed to be established for simplifying explanation hereunder.

FIG. 5B illustrates an example of the potential to each gradation, when each area of the peripheral surface of the charged photoconductor drum 202 is exposed to light by the PWM-modulated laser beams in accordance with a contrast of the image. Each area of the photoconductor drum 202 shows the potential according to the contrast of the corresponding image. This is the electrostatic latent image. The potential of the peripheral surface of the photoconductor drum 202 corresponding to each gradation is called a latent image potential. In FIG. 5B, arrow in a horizontal direction shows a corresponding relationship between the latent image potential and contrast of brightness of the image. A brightest part of the image (usually, a white background part) is not exposed to light. Accordingly, the charging potential of −600V is maintained as the latent image potential of the white background part. Meanwhile, a dark part of the image is most strongly exposed to light. Thus, the potential of the peripheral surface of the photoconductor drum 202 is lowered toward the ground potential. In an example of FIG. 5B, the latent image potential of the dark part is −50V. A change of the latent image potential between a bright part and a dark part, namely, gradation characteristics or γ characteristics shows soaring characteristics. Note that a step-shaped graph shows that a resolution of the PWM modulation is a finite discrete value. However, it can be said that the resolution of the PWM modulation is substantially a continuous value.

Developing bias voltage Vdv from the developing bias power supply 62 is applied to the developing roller 187. Therefore, the surface of the developing roller 187 shows the potential (developing potential) equal to the developing bias voltage. The developing potential is controlled to −500V closer to the dark part against the latent image potential −600V of the white background part. A potential difference from the latent image potential of the white background part is provided for surely preventing an adhesion of the toner to the white background part. The adhesion of the toner means the "fog" in a broad sense. The toner is charged to a negative polarity by a friction with the carrier. The toner of an amount according to a difference between the developing potential and the latent image potential is adhered to an area of the electrostatic latent image having a positive latent image potential as a reference of the developing bias voltage.

The transfer roller 207 and the transfer belt 206 have conductivity. When the print sheet passes through the area (transfer area) sandwiched between the photoconductor drum 202 and the transfer belt 206, the controller 81 controls the transfer power supply 63 so that the transfer voltage Vt of −2 kV is applied to the transfer roller 207. The print sheet has an insulating property. In the transfer area at this time, a capacitor is formed, with the base material of the photoconductor drum 202 set as one of the electrodes, and the transfer roller 207 and the transfer belt 206 set as the other electrode. The toner in the transfer area is transferred to the print sheet from the surface of the photoconductor drum 202 by an action of an electrical field generated by the transfer voltage.

Each potential and a value of the voltage is an example in the aforementioned explanation. It is a usual example that the image forming apparatus in recent years has an image density correcting function, being a function of a so-called process control, for stabilizing the density of the image. In the image density correction, the controller 81 forms and develops a test pattern for measuring density. Then, by using a density measurement section (not shown), the density of the developed test pattern is measured on the surface of the photoconductor drum 202 or on the transfer belt 206. Then, based on a measurement result, the controller 81 determines values of the grid voltage, the developing bias voltage, and the transfer voltage. The following image formation is performed by using each determined voltage.

Figures 6A, 6B, 6C, 6D:
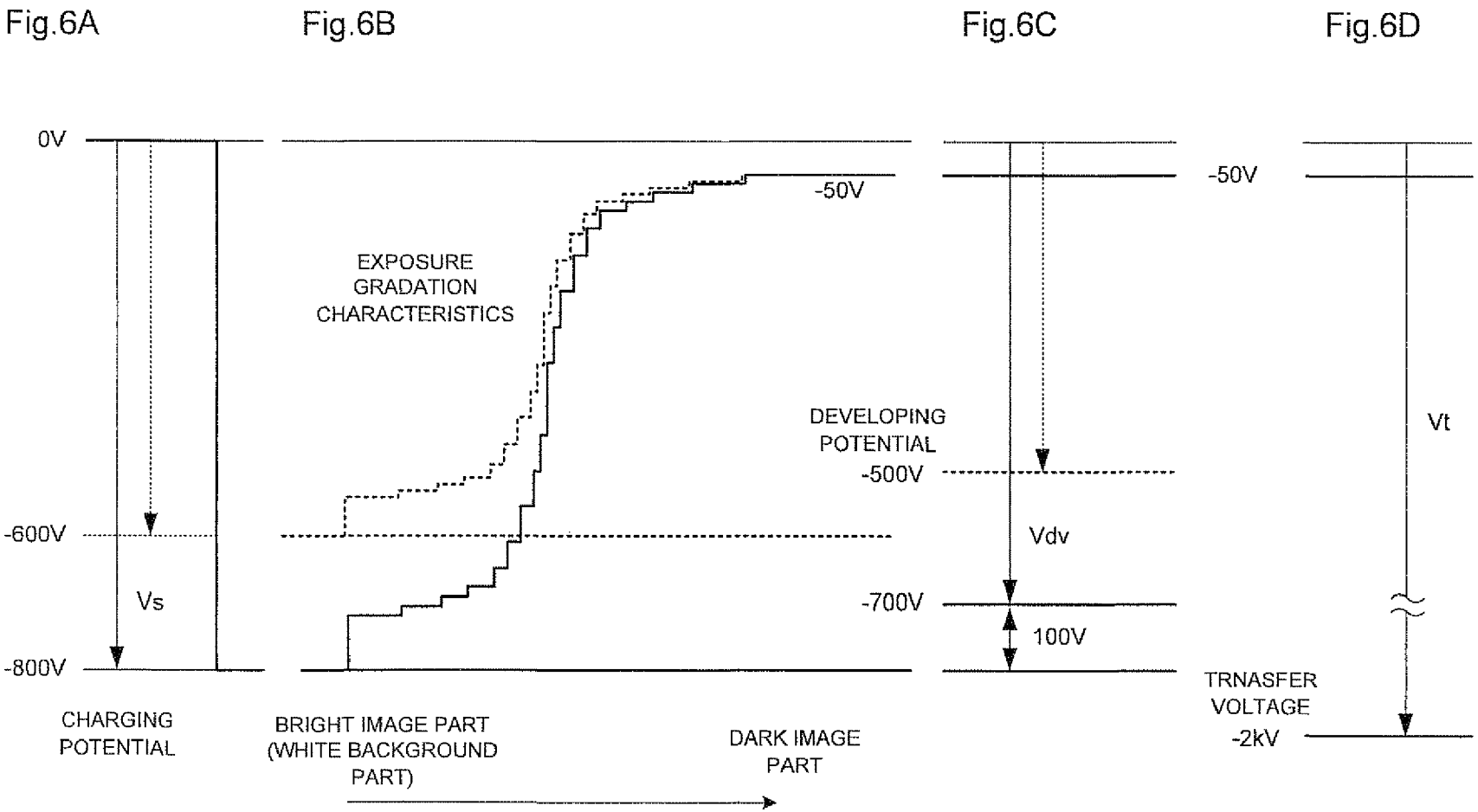
FIGS. 6A to 6D are explanatory views illustrating an example of an updated charging potential, an updated potential of an electrostatic latent image of the electrophotographic process having a plurality of image densities, an updated developing potential and an updated developing potential according to this embodiment.

For example, when it is so determined that the density is low as a result of measuring the density of the test pattern, the controller 81 determines an appropriate charging potential in accordance with the measurement result. Further, the developing potential according to the updated charging potential is determined. FIGS. 6A to 6D are explanatory views illustrating an example of an updated charging potential, an updated potential of an electrostatic latent image of the electrophotographic process having a plurality of image densities, an updated developing potential and an updated developing potential according to this embodiment. In the example of FIG. 6, the updated charging potential is −800V, and the updated developing potential is −700V. Namely, the developing potential is updated so as to maintain the potential difference (100V) between the charging potential and the developing potential. Based on the updated charging potential and the developing potential, the controller 81 controls the grid voltage Vg and the developing bias voltage Vdv, in the following image formation.

Generally, along with a use of a developer and the photoconductor drum 202, the density of the image is lowered. Accordingly, the function of the process control has a tendency of setting an absolute value of the grid voltage to be large with a lapse of time. Along with this tendency, the absolute value of the developing bias voltage is also set to be large. When the developer and/or the photoconductor drum 202 is replaced with a new one, the absolute value of the grid voltage and developing bias voltage become smaller. However, the aforementioned tendency is a general tendency, and the absolute values of the grid voltage and the developing bias voltage are not always updated in a direction where the absolute values of the grid voltage and the developing bias voltage are set large. The values of a new grid voltage and the developing bias voltage depend on the measurement result of the density.

Control Method for Suppressing Fog Generation

A suppressing method of the fog will be explained. Based on a test result of FIG. 1, inventors conceive of a control as follows. Namely, as a result of continuing the printing at a low toner coverage ratio and correcting the image density, the toner in a developing tank is replaced, when a target absolute value of the grid voltage becomes large up to a prescribed value. Alternately, the toner in the developing tank is replaced when the absolute value of the developing bias voltage becomes large up to the prescribed value instead of the grid voltage. In correcting the image density, a target value of the developing bias voltage is determined, depending on the target value of the grid voltage. Therefore, it can be so considered that both of the developing bias voltage and the grid voltage have the same result.

The toner is preferably replaced when the density of the test pattern is measured in correcting the density of the image. Specifically, the toner is preferably replaced by forming the image of a halftone or a halftone dot pattern as a toner discharging pattern, and developing this image.

Note that while the formed toner discharging pattern passes through the transfer area, preferably, electrical floating of the transfer roller 207 is executed for reducing or preventing a stain of the transfer belt 206, or the transfer voltage of the same polarity as the charging polarity of the toner is applied to the transfer roller 207.

Further, after the formed toner discharging pattern passes through the transfer area, preferably the voltage, having the same polarity as the charging polarity of the toner and a larger absolute value than that of the charging potential of the photoconductor is applied as a transfer voltage.

Figure 7:
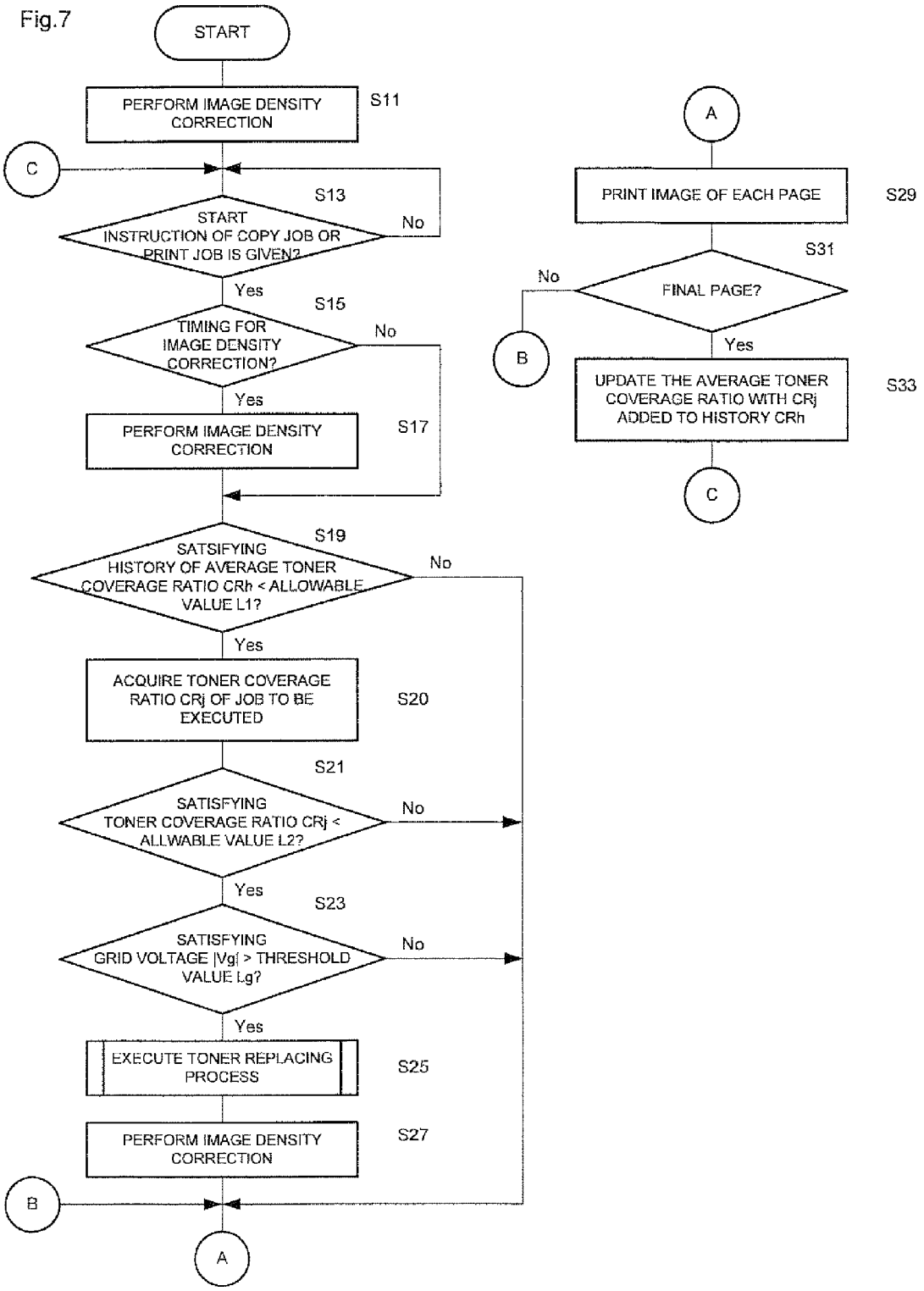
FIG. 7 is a first flowchart illustrating an execution procedure of a toner replacing process.
Figure 8:
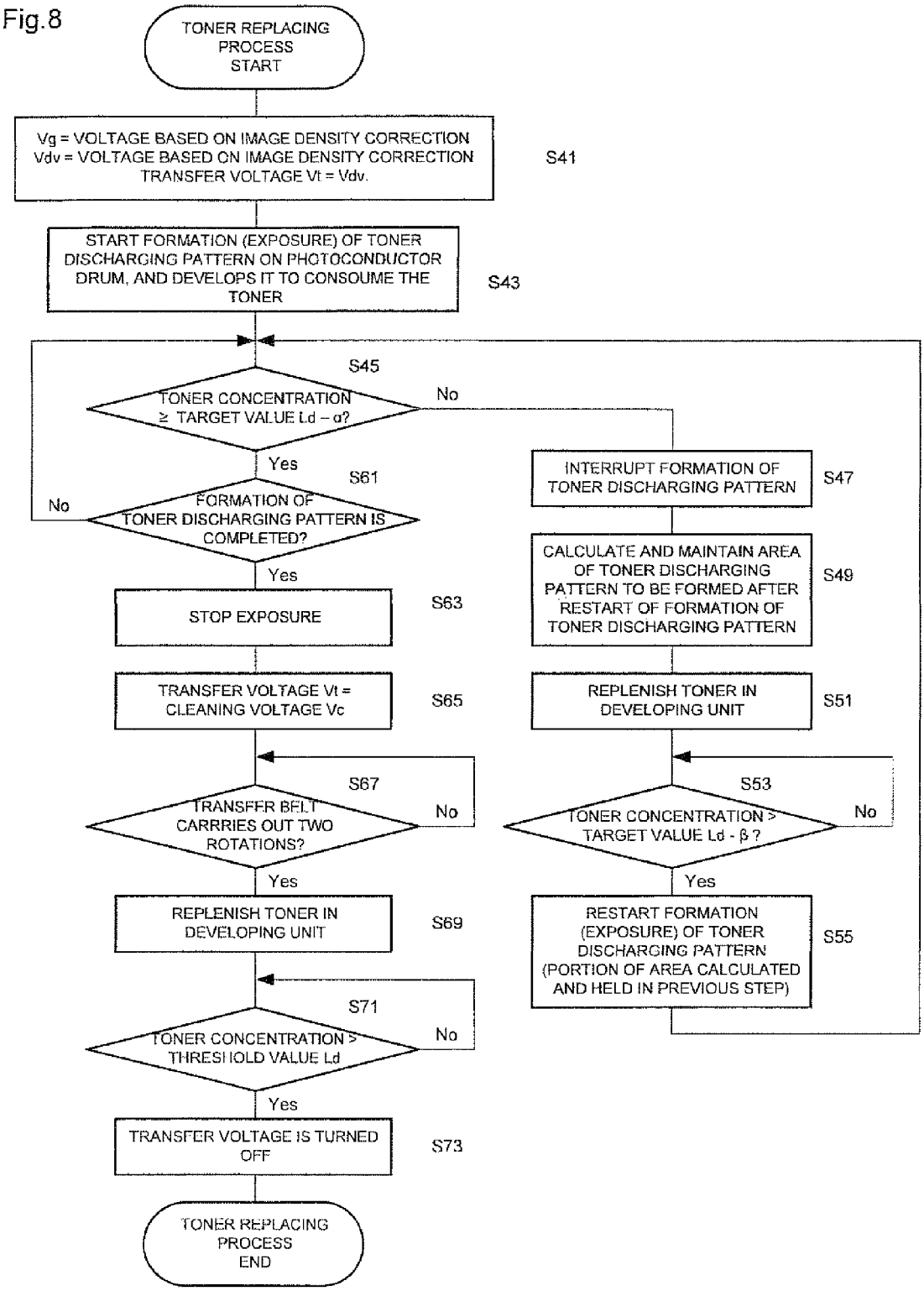
FIG. 8 is a second flowchart illustrating the execution procedure of the toner replacing process.

A detailed procedure of the toner replacing process will be explained hereunder. FIG. 7 and FIG. 8 are flowcharts showing the procedure of executing the toner replacing process by the controller 81.

First, in FIG. 7, the control of the controller 81 executes correction of image density after turning on the power, and then updates the values of the grid voltage and the developing bias voltage in the image formation (step S11). Then, the image formation of a series of pages, namely the start instruction of a job is awaited (step S13). As described above, a copy job and a print job, etc, for example, are given as the types of the job. When the start instruction of the job is received, first, the controller 81 determines whether or not the timing for executing the image density correction arrives (step S15). This is because the image density correction is intermittently executed, for example for each previously defined number of print pages or elapse of a period. When a time opportunity for performing image density correction does not arrive yet, the routine is advanced to step S19. Meanwhile, when the timing for the image density correction arrives, the controller 81 executes the image density correction, and then updates the values of the grid voltage and the developing bias voltage in the image formation (step S17).

Next, the controller 81 determines whether or not history data DRh at an average toner coverage ratio of the image printed in the past prescribed period is under a previously defined allowable value L1 (step S19). Here, the history data CRh is the data stored in the nonvolatile memory. When a determined result is No, the routine is advanced to step S29, and print of each page is started. The meaning of the determined result of No is that the past printing is performed at the toner coverage ratio of the allowable value or more, thus providing a circumstance where the fog is hardly generated. Meanwhile, when the determined result is Yes, the controller 81 acquires toner coverage ratio CRj of the job for printing from now, from the image data creating section 82 or the image data output section 83 (step S20). Then, whether or not the toner coverage ratio CRj is a previously defined allowable value L2 or less is determined (step S21). The allowable value L2 is the value previously defined according to a size of a page to be printed, the number of pages, and the toner coverage ratio of each page. When the determined result is No, the routine is advanced to step S29, and the print of each page is started. The meaning of the determined result of No is that the toner of a prescribed amount or more is consumed in the next print. Note that when the data to be printed at a processing time point of steps S20 and S21 is not acquired yet, the routine is advanced in a direction of the determined result of Yes. The same thing can be said for a case that the image data creating section 82 and the image data output section 83 have no capability of providing the toner coverage ratio CRj.

When the determined result is Yes, the controller 81 acquires an output value Vg of the grid voltage determined based on the image density correction, and determines whether or not its absolute value is larger than a previously defined threshold value Lg (step S23). When the determined result is No, the routine is advanced to step S29, and the print of each page is started. The meaning of the determined result of No is that the absolute value of the grid voltage Vg (namely, the charging potential Vs of the photoconductor) is the allowable value or less, thus providing the circumstance where the fog is hardly generated. When the determined result is Yes, the controller 81 executes the toner replacing process to replace the toner in the developing unit 200 (step S25). The detailed procedure of the toner replacing process will be described separately later.

After the toner replacing process is ended, the controller 81 executes the image density correction again. Then, new grid voltage and developing bias voltage are obtained. After the toner replacing process is executed, a deteriorated toner is discharged, then the density of the image easily appears, and the absolute values of the grid voltage and the developing bias voltage are generally made smaller.

Thereafter, the controller 81 starts the print of each page (step S29). When the print up to a final page of the job is ended (step S31), the controller 81 updates the history data CRh at an average toner coverage ratio (step S33). Namely, the toner coverage ratio CRj of each page printed by executing the job is reflected on the history data CRh. Here, the history data CRh is the past average toner coverage ratio ranging over prescribed pages. Out of these pages, the page printed this time, namely the page being a target of the toner coverage ratio CRj, is added to the history data and an old page in the history data is deleted from the object of the history data, so as to cancel the portion of the added page. Then, the average toner coverage ratio of the object page of the updated history data is calculated and maintained as the value of the updated CRh.

Subsequently, a detailed procedure of the toner replacing process will be explained based on FIG. 8. In FIG. 8, first, regarding the grid voltage Vg and the developing bias voltage Vdv, the controller 81 maintains the voltage based on the image density correction and outputs the voltage equal to the developing bias voltage Vdv, as the transfer voltage Vt (step S41). The transfer voltage Vt is set at a prescribed voltage (−2 kV in FIG. 5 and FIG. 6) during forming the image at a timing when the print sheet passes through the transfer area. Then, although set at 0V at other timing, the transfer voltage Vt is set at the voltage equal to the developing bias voltage Vdv during the toner replacing process.

Then, exposure of the optical scanning unit 204 is started to form the toner discharging pattern on the photoconductor drum 202. The formed toner discharging pattern is then developed to consume the toner in the developing unit 200 (step S43). An area for forming the toner discharging pattern is previously defined. This is because the toner amount consumed by the toner replacing process is approximately determined by this area and the density of the toner discharging pattern.

During developing the drum discharging pattern, the controller 81 monitors the toner concentration and determines whether or not the toner concentration is below a control target value Ld of the toner concentration by a previously defined margin a (step S45). Here, the target value Ld is the value for controlling the supply of the toner by the controller 81, to maintain the toner concentration in the developing unit 200. As described above, the toner amount consumed by the toner replacing process is approximately fixed, and the toner concentration after the toner replacing process is also fixed. However, there is a variation depending on a surrounding environment such as temperature and humidity and the toner concentration at the time of starting the toner replacing process. When the toner concentration is excessively lowered, a trouble such as a drop of the carrier from the developing unit occurs. Therefore, the controller 81 checks so that the toner concentration is not lowered beyond the margin $\alpha$.

When the determined result of step S45 is Yes, consumption of the toner is continued, and end of forming the toner discharging pattern is awaited (step S61). When the determined result is No, namely, when the toner concentration is excessively lowered, the routine is advanced to step S47. Here, the controller 81 interrupts the exposure of the toner discharging pattern (step S47), calculates the area of the toner discharging pattern to be formed when image formation is restarted later, the calculated area of the toner discharging pattern is then temporarily maintained (step S49). The area may be the remaining area of the toner discharging pattern at the time point of interruption. However, the area is preferably calculated and corrected in consideration of the toner amount replenished thereafter. Then, the controller 81 replenishes the toner in the developing unit 200 to increase the toner concentration (step S51). Then, recovery of the toner concentration up to the value smaller than the target value Ld by $\beta$($\beta$21 $\alpha$) is awaited (step S53). Here, $\beta$ may be a previously defined value or may be calculated by the controller 81 in step S49, according to the remaining area of the toner discharging pattern.

When the toner concentration recovers up to Ld to $\beta$, the controller 81 restarts the exposure of the toner discharging pattern (step S55). The toner discharging pattern formed thereafter is the area calculated in the aforementioned step S49. After the exposure of the toner discharging pattern is restarted, the routine is advanced to step S45, and the end of the toner discharging pattern is awaited while monitoring the toner concentration.

When the formation of the toner discharging pattern is ended, the controller sets the transfer voltage Vt as a prescribed cleaning voltage Vc (step S65) in a state of not exposing the photoconductor drum 202 with the optical scanning unit 204, and waits until the transfer belt 206 goes 2 rounds (step S67). The cleaning voltage Vc is the voltage of the same polarity as the charging polarity of the toner. As an example, Vc=+450V is established. Thus, the toner adhered to the surface of the transfer belt 206 is transferred to the photoconductor drum 202 side and the transfer belt 206 is cleaned. Note that the toner transferred to the photoconductor drum 202 is retrieved by the cleaning unit 208. While the transfer belt 206 goes 1 round or more (2 rounds in the embodiment of FIG. 8), the transfer belt 206 is cleaned.

In addition, the controller replenishes a new toner to the developing unit 200 to increase the toner concentration (step S69). Then, the recovery of the toner concentration up to a target value Ld is awaited (step S71). Note that replenishment of the toner may be performed in parallel to the cleaning of the transfer belt 206. When the toner concentration is recovered, the transfer voltage is turned off (step S73).

Test Result

Figure 9:
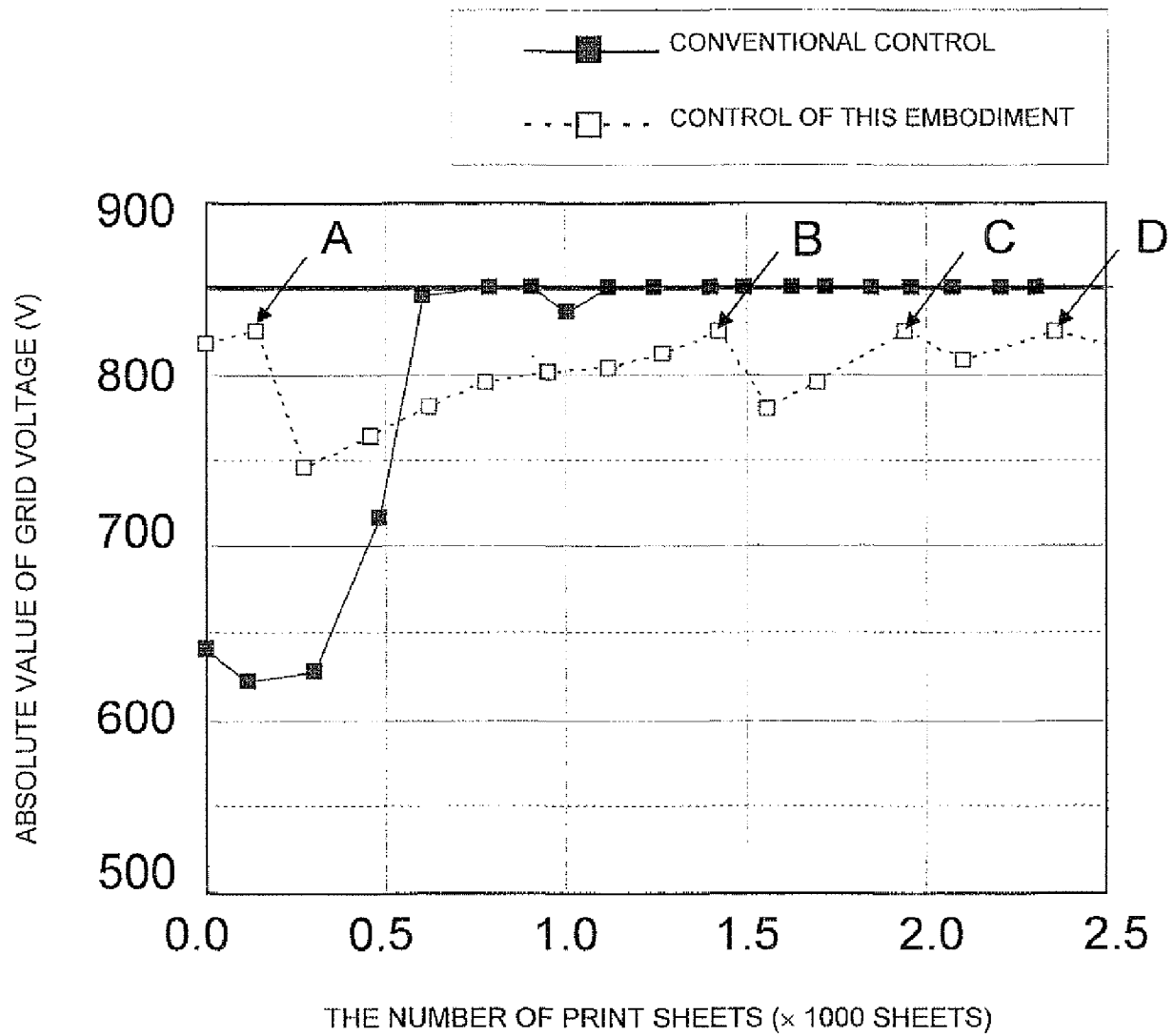
FIG. 9 is a graph of a test result showing effectiveness of a control method according to this embodiment.

FIG. 9 is a graph of a test result showing an effectiveness of a control method according to this embodiment. In FIG. 9, a horizontal axis indicates the number of print sheets, and a vertical axis indicates the grid voltage Vg. The image at the toner coverage ratio of 0.4% is printed and the grid voltage Vg that varies with process control is plotted in this figure. A square connected by a solid line shows a conventional control method. A hollow square connected by a chain line shows the control method according to this embodiment.

In the image forming apparatus used in a test, a process speed is set at 350 mm/second, volume of the developer in the developing unit is set at 900 g by mass, the target value Ld of the toner concentration is set at 5.0%, a lower limit value of the toner concentration is set at 4.5% (namely, a=0.5%), the amount of the toner consumed by a single toner replacing process is set at 6 g by mass, and the allowable value L1 of the toner coverage ratio is set at 0.5%. Note that the absolute value of the grid voltage has a controllable upper limit of 850V, and the absolute value of the developing bias voltage has a controllable upper limit of 700V.

As shown in FIG. 9, when the printing at a low toner coverage ratio is continued by the conventional control method, the toner is deteriorated and the image density is lowered. Therefore, when the process control is executed, the absolute value of the grid voltage becomes large. In FIG. 9, the absolute value of the grid voltage reaches 850V, being an upper limit value in the vicinity of 600 sheets, and this upper limit value is maintained thereafter.

Meanwhile, in the control method according to this embodiment, when the grid voltage is increased beyond a threshold value Lg=825V, the toner replacing process is executed and the grid voltage drops. In FIG. 9, the grid voltage exceeds the allowable value over four times of A, B, C, D, and the toner replacing process is executed. After the toner replacing process is executed, the density of the image easily appears. Therefore, the absolute value of the grid voltage becomes small. As a result, even in a case where the number of print sheets reaches near 2,500 sheets, being the number of print sheets where the fog is easily generated, the grid voltage can be below the upper limit value.

In addition, in FIG. 9, as the toner replacing process is repeated, the absolute value of the grid voltage is less frequently made small. This is because the toner amount consumed in the toner replacing process is small. Accordingly, by optimizing the amount of the toner to be consumed, the effect could be further maintained.

Various types of modified examples are possible in addition to the above-described embodiments. These modified examples should not be interpreted as not belonging to the scope of the claims of the present technology. All modifications in the scope of the claim and in the meaning equal to the scope of the claim should be included in the technology.

What is claimed is:

1. An image forming apparatus comprising:

an image forming section for forming an image by an electrophotographic process, the image forming section including a photoconductor, a charging unit, a developing unit, a toner supply unit which supplies a toner to said developing unit, and a developing bias power supply section which supplies a developing bias voltage to said developing unit; and a controller that activates said image forming section to form the image, determines a target value of a charging potential of said photoconductor and/or a developing bias voltage, for forming the image, and controls the charging unit and/or the developing bias power supply section in accordance with a determined result, wherein when an absolute value of the determined target value of the charging potential or an absolute value of the determined developing bias voltage is larger than a prescribed value, said controller controls replacement of a prescribed amount of a toner in the developing unit without printing an image on a printing sheet.

2. The image forming apparatus according to claim 1, further comprising:

a density measuring section for measuring a density of the formed image, wherein when a prescribed opportunity comes, said controller activates the image forming section to form an image of a pattern having the prescribed amount of a toner, activates the density measuring section to measure a density of said image, calculates a target value of the charging potential and a developing bias voltage, based on the measured result, controls subsequent image formation based on the calculated result, and determines whether or not the toner is replaced before a next image is formed.

3. The image forming apparatus according to claim 1, wherein said controller activates the image forming section to form an image of a pattern using said prescribed amount of a toner, then activates the toner supply unit to replenish the developing unit with a new toner so as to make the replacement of the toner.

4. The image forming apparatus according to claim 3, wherein said pattern using the prescribed amount of the toner has a width almost equal to a maximum width which can be developed, and is a substantially uniform halftone or dot-shaped pattern.

5. The image forming apparatus according to claim 3, wherein said pattern using the prescribed amount of the toner is in a prescribed size.

6. The image forming apparatus according to claim 3, further comprising:

a transfer section that transfers the image formed by the image forming section to a printing sheet; and a transferring power supply section that is capable of applying a transfer voltage to the transfer section, wherein said controller controls the transferring power supply section so that the transfer section floats potentially or a voltage of a polarity which is the same as a charging polarity of the toner is applied to the transfer section, while said pattern using the prescribed amount of the toner passes through the transfer section.

7. The image forming apparatus according to claim 6, wherein said transfer section has a transfer member coming in contact with a surface of the photoconductor, and said controller controls the transferring power supply section so that the voltage of the same polarity as the charging polarity of the toner and the voltage of an absolute value larger than that of the charging potential of the photoconductor is applied to said transfer member, after said pattern using the prescribed amount of the toner passes through the transfer section.

8. The image forming apparatus according to claim 7, wherein said photoconductor is formed in an endless shape to rotate when an image is formed, and said controller controls the transferring power supply section so that said voltage is applied to said transfer member, while the photoconductor rotates two or more times after said pattern using the prescribed amount of the toner passes through the transfer section.

9. The image forming apparatus according to claim 1, further comprising:

a toner coverage ratio recognizing section that recognizes a toner coverage ratio of an image before the image is formed, wherein said controller controls the replacement of the toner only when the recognized toner coverage ratio is under a prescribed value, and the toner is not replaced when a toner coverage ratio of an image to be formed is recognized and the recognized toner coverage ratio is the same as the prescribed value or more, even if the absolute value of the target value of the charging potential or the absolute value of the developing bias voltage according to said target value is a value in which a process of replacing the toner is carried out.

10. The image forming apparatus according to claim 1, wherein said controller controls the replacement of the toner such that the toner is consumed while the developing unit is not replenished with a new toner at first, and then the developing unit is replenished with the new toner, in a process of replacing the toner.

11. The image forming apparatus according to claim 10, wherein said controller controls the replacement of the toner such that the consumption of the toner is discontinued when a toner density in the developing unit decreases to a prescribed lower limit while the process of replacing the toner is carried out.

12. The image forming apparatus according to claim 11, wherein said controller controls the replacement of the toner such that the developing unit is replenished with a new toner after the consumption of the toner is discontinued, and then the toner is consumed again.

13. The image forming apparatus according to claim 1, further comprising:

a transfer section that transfers the image formed by the image forming section to a printing sheet; and a sheet supply section that supplies a printing sheet to the transfer section, wherein said controller further controls said sheet supply section so that said printing sheet is not supplied to the transfer section while a process of replacing the toner is carried out.

14. The image forming apparatus according to claim 1, wherein said controller controls replacement of a prescribed amount of a toner in the developing unit only if a coverage ratio for a newly requested print job is lower than a predetermined threshold value.

15. The image forming apparatus according to claim 1, wherein said controller controls replacement of a prescribed amount of a toner in the developing unit only if a coverage ratio for a newly requested print job is lower than a predetermined threshold value, and the determined target value of a charging potential of said photoconductor is above a predetermined threshold value.

* * * * *